United States Patent [19]

Ross et al.

[11] Patent Number: 5,048,610

[45] Date of Patent: Sep. 17, 1991

[54] SINGLE BORE PACKER WITH DUAL FLOW CONVERSION FOR GAS LIFT COMPLETION

[75] Inventors: Colby M. Ross, Carrollton; Richard M. Sproul, Grapevine; Ross M. McCurley, Flower Mound; Carter R. Young, Dallas, all of Tex.

[73] Assignee: Otis Engineering Corporation, Carrollton, Tex.

[21] Appl. No.: 491,463

[22] Filed: Mar. 9, 1990

[51] Int. Cl.[5] ..... E21B 43/16; E21B 33/129

[52] U.S. Cl. ..... 166/372; 166/117.5; 166/120; 166/129; 166/133; 166/387

[58] Field of Search ..... 166/372, 387, 313, 117.5, 166/129, 331, 133, 183, 120

[56] References Cited

U.S. PATENT DOCUMENTS

| | | | |
|---|---|---|---|
| 3,410,348 | 11/1968 | Page | 166/129 X |
| 3,460,616 | 8/1969 | Tucker et al. | 166/120 |
| 4,031,955 | 6/1977 | Leader | 166/183 |
| 4,258,787 | 3/1981 | Amancharla | 166/120 |
| 4,271,903 | 6/1981 | Slagle, Jr. et al. | 166/129 |
| 4,294,313 | 10/1981 | Schwegman | 166/117.5 |
| 4,448,216 | 5/1984 | Speegle et al. | 166/332 X |
| 4,449,587 | 5/1984 | Rodenberger et al. | 166/332 X |
| 4,540,047 | 9/1985 | Akkerman | 166/117.5 X |
| 4,682,656 | 7/1987 | Waters | 166/372 |
| 4,708,595 | 11/1987 | Maloney et al. | 166/372 X |

*Primary Examiner*—Hoang C. Dang

*Attorney, Agent, or Firm*—Dennis T. Griggs

[57] ABSTRACT

A single bore packer is modified by a dual flow seal unit for gas lift completion. This permits the operator to inject lift gas into the upper casing annulus at the well head, bypass the hanger packer and conduct the lift gas into the suspended production tubing below the fluid level. The dual flow seal assembly is sealed internally against the packer mandrel, with the lift gas being conducted through a bypass flow passage between the seal mandrel and the packer mandrel, and being discharged into the lower casing annulus through a discharge port formed through the packer mandrel below the packer seal element package. The hang weight load of the production tubing is decoupled with respect to the packer seal elements by a set of internal ratchet slips which transfers the hang weight load from the packer mandrel onto the anchor slips and well casing at a location below the seal element package.

6 Claims, 6 Drawing Sheets

SINGLE BORE PACKER WITH DUAL FLOW CONVERSION FOR GAS LIFT COMPLETION

FIELD OF THE INVENTION

This invention relates generally to well completion and production, and in particular to a hydraulic packer and dual flow seal assembly for completing and producing a gas lift well.

BACKGROUND OF THE INVENTION

Gas lift is a commonly used method for producing wells which are not self flowing. Gas lift consists of initiating or stimulating well flow by injecting gas at some point below the fluid level in the well. When gas is injected into the formation fluid column, the weight of the column above the point of injection is reduced as a result of the space occupied by the relatively low density gas. This lightening of the fluid column is sufficient in some wells to permit the formation pressure to initiate flow up the production tubing to the surface. Gas injection is also utilized to increase the flow from wells that will flow naturally but will not produce the desired amount by natural flow.

In gas lift operations, the well may be produced through either the casing or the production tubing. If the well is produced through the casing, the lift gas is conducted through a tubing string to the point of injection, and if the well is produced through production tubing, the lift gas is conducted to the point of injection through the casing annulus or through an auxiliary tubing string.

DESCRIPTION OF THE PRIOR ART

In the course of treating and preparing a gas well for production, a hanger packer along with a production seal unit is run into the well on a work string, with the packer being set against the casing bore. The purpose of the packer is to support production tubing and equipment such as a relief valve and multiple gas lift injection valves in the lower well casing while sealing the annulus between the outside of the production tubing and the inside of the well casing to prevent movement of fluids through the annulus past that location. The packer is provided with anchor slip members having opposed camming surfaces which cooperate with complementary opposed wedging surfaces, whereby the anchor slip members are extendable radially into gripping engagement against the well casing bore in response to relative axial movement of the wedging surfaces. The packer also carries annular resilient seal elements which expand radially into sealing engagement against the bore of the well casing in response to axial compression forces. Longitudinal movement of the packer components which set the anchor slips and the sealing elements may be effected either hydraulically or mechanically.

It is necessary to conduct the pressurized lift gas through the hanger packer into the lower casing annulus. This may be accomplished by injecting the pressurized lift gas into the lower casing annulus through one bore of a dual bore hanger packer. Such dual bore completion arrangements have been used successfully in shallow wells in which the length of the production tubing supported by the dual bore packer is relatively short, and for wells having a relatively low flow rate which can be accommodated by the reduced diameter production bore of the dual bore hanger packer.

In gas lift wells, it is desirable to maximize the production bore of the hanger packer to accommodate high flow rate production. In a deep well, for example 10,000–15,000 feet in depth, the hanger packer is installed above the formation fluid level of the production zone and supports a long production tubing string together with side pocket mandrels and lift gas injection valves. In order to limit the amount of lift gas that is allowed to freely escape if the well head has become damaged, the hanger packer is preferably installed relatively close to the surface. In some installations, the hanger packer may be installed between 800 and 1,000 feet in depth. With the hanger packer being set at such a shallow depth, the hang weight of the tubing, for example 5½ inch bore, 20 pound production tubing which is supported by the packer, becomes very large. Normally, in most completions, the well head is designed to support the hang weight load, but because the hanger packer is set near the surface in deep wells, it is the hanger packer which supports the suspended hang weight.

The well casing is reinforced by an annular cement lining at the bottom of the well, and also along an upper support casing which is suspended from the well head. However, the annulus between the production well casing and the upper support casing at the hanger packer installation region is uncemented and unsupported. Because of the high hang weight of the production tubing string which is supported by the hanger packer, high setting forces are applied on the seal elements of the hanger packer. Because of the high level of radially directed setting forces exerted by the setting force of the seal elements, there is a risk of exceeding the plastic yield limit of the well casing, thereby causing it to collapse outwardly, or else permanently yield and/or burst along the engagement area between the seal elements and the well casing bore.

SUMMARY OF THE INVENTION

The lift gas completion and production apparatus of the present invention allows the operator to inject lift gas into the upper casing annulus at the well head, bypass the hanger packer and conduct the lift gas into the suspended production tubing below the fluid level, while minimizing the volume of injection gas contained within the upper casing annulus and maximizing the production bore through the hanger packer to accommodate high production flow rate conditions, and without exceeding the well casing yield strength. This is achieved in part by locating the hanger packer near the well head, thereby reducing the volume of the upper casing annulus.

The production bore diameter is maximized by the use of a single bore packer in combination with a dual flow seal assembly. The dual flow seal assembly has a side pocket mandrel in which a lift gas safety valve is installed, and has a production mandrel radially spaced from the packer bore, thereby defining an annular bypass flow passage for conducting lift gas from the upper casing annulus through the packer bore into the lower casing annulus. For this purpose, the lift gas safety valve has an inlet port in communication with the upper casing annulus, and the packer has a discharge port connecting the bypass passage in communication with the lower casing annulus.

The hang weight load of the production tubing below the packer is unloaded with respect to the packer seal elements by a set of internal ratchet slips which transfer the hang weight load from the packer mandrel onto the anchor slips and well casing. After tension in the tubing string above the packer has been relieved by actuation of a travel joint, the weight of the upper tubing string is also unloaded from the seal element package because the weight of the upper tubing string is transferred through the internal slips and anchor slips onto the well casing. The advantage of the internal ratchet slip structure is that the well casing is subjected to loading by the seal elements only at normal setting pressures, with the hang weight load of the tailpipe production tubing and stack loading of the upper production tubing being effectively removed from the seal element package, thereby avoiding yield deformation of the well casing.

Another advantage provided by the dual flow seal unit of the present invention is that a substantially larger production bore can be achieved through the packer since the dual flow mandrel is sealed against the packer mandrel immediately below the packer seal elements, as compared with conventional single bore packer arrangements in which a tubular stinger conduit attached to the seal unit extends completely through the packer bore and is landed in sealing engagement with the polished bore of a landing nipple within the lower casing annulus. That arrangement requires the stinger conduit to carry an external O-ring seal for engaging the landing nipple, thereby reducing the effective diameter of the stinger conduit by as much as 1 inch. That size limitation is overcome, according to one aspect of the present invention, by sealing the dual flow mandrel directly against the bore of the packer mandrel, with the lift gas being conducted through the bypass annulus and discharged through mandrel ports below the packer seal elements.

Other features and advantages of the present invention will be appreciated by those skilled in the art upon reading the detailed description which follows with reference to the attached drawings.

DETAILED DESCRIPTION OF THE PREFERRED EMBODIMENT

Figure 1A:
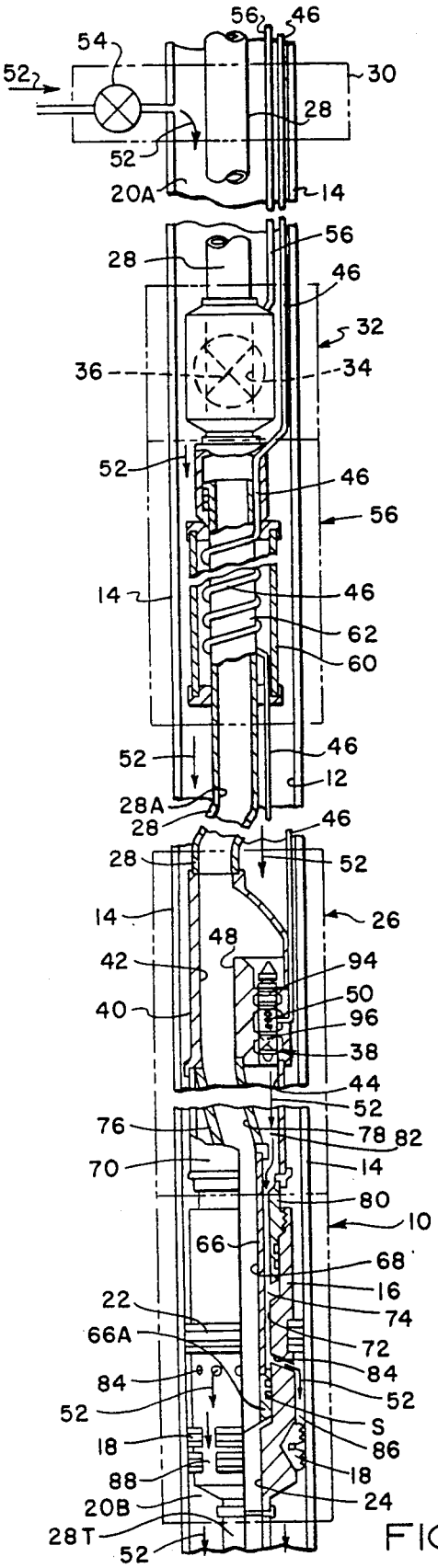
FIG. 1A is a simplified elevational view, partly in section, showing a typical gas lift well installation in which the apparatus of the present invention is installed.

In the description which follows, like parts are marked throughout the specification and drawings with the same reference numerals, respectively. The drawings are not necessarily to scale and the proportions of certain parts have been exaggerated to better illustrate particular details of the present invention.

Figure 1B:
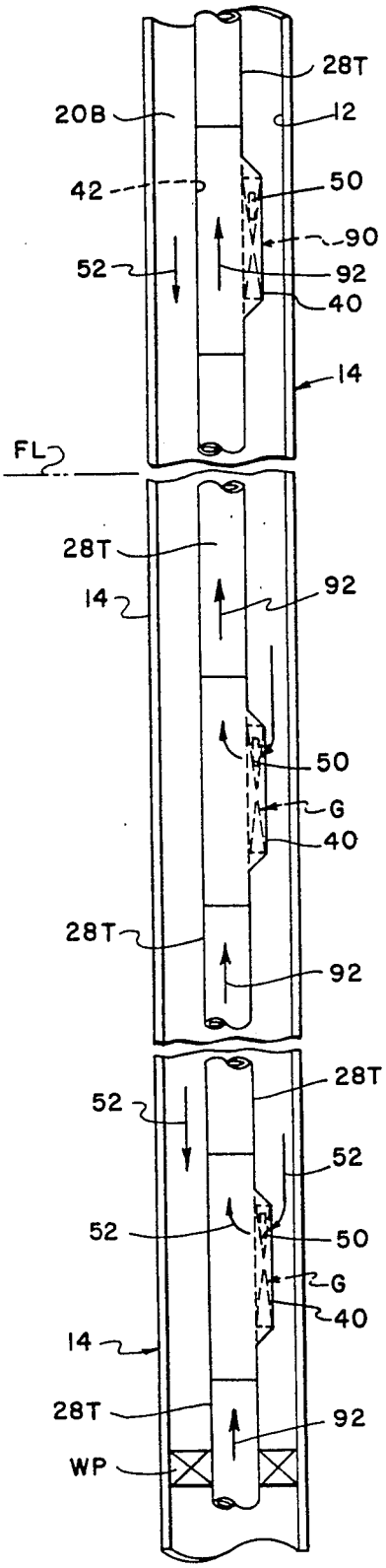
FIG. 1B is a continuation of FIG. 1A which illustrates the relative positions of lift gas valves which are supported within the lower casing annulus below a hanger packer.

Referring now to FIG. 1A and FIG. 1B, a gas lift installation includes hanger packer 10 which is releasably anchored at an appropriate depth within the bore 12 of a well casing 14. The packer 10 is provided with a mandrel 16 having hydraulically actuated slips 18 which set the packer against the well casing bore 12. The casing annulus 20 is sealed above and below the packer by expanded seal elements 22, thereby dividing the casing annulus into an upper annulus 20A and a lower annulus 20B. The packer mandrel 16 has a large diameter, central bore 24 through which production flow and lift gas flow are separately conducted as hereinafter described.

A dual flow seal assembly 26 is connected to a production tubing string 28 which is suspended from well head surface equipment 30. The well head surface equipment 30 includes a casing head through which the packer 10 and the dual flow seal assembly 26 are inserted into the well casing bore and which prevents the flow of fluids out of the well casing annulus.

A surface controlled, subsurface production safety valve 32 having a production bore 34 and a movable valve closure element 36 is connected in series with the upper production tubing string 28. The production safety valve 32 is preferably of the flapper type as described in U.S. Pat. No. 4,449,587 to Charles M. Rodenberger, et al., or it may be of the ball valve closure type as described in U.S. Pat. No. 4,448,216 to Speegle, et al. Both of these patents are incorporated by reference for all purposes within this application.

The dual flow seal assembly 26 includes a lift gas safety valve 38 mounted within a side pocket sub 40 having a production bore 42 connected in series with the production tubing 28 and having annular bypass flow passage 44 formed below the safety valve 38. The lift gas safety valve 38 includes a hydraulically actuated piston and valve closure assembly which is coupled in fluid communication with a hydraulic flow control line 46. The lift gas safety valve 38 is received within an offset mandrel housing 48 which has an inlet port 50 through which lift gas 52 is admitted from the upper casing annulus 20A. A preferred embodiment of the lift gas safety valve 38 is disclosed in copending U.S. application Ser. No. 07/487,398assigned to the assignee of the present invention, and incorporated herein by reference for all purposes.

The well casing annulus 20A above the packer 10 is pressurized with lift gas 52, which is conducted into the upper casing annulus through a surface valve 54 located at the well head 30. The hydraulic flow control line 46 delivers hydraulic control fluid to lift gas safety valve 38 from a surface control unit located at the well head 30, which supplies hydraulic control fluid under pressure from a pump. Likewise, a hydraulic control line 56 delivers hydraulic control fluid to the production safety valve 32. Removal of hydraulic pressure from the control lines 46, 56 causes automatic release of spring loaded closure elements in the production safety valve 32 and the lift gas safety valve 38.

Figure 2A:
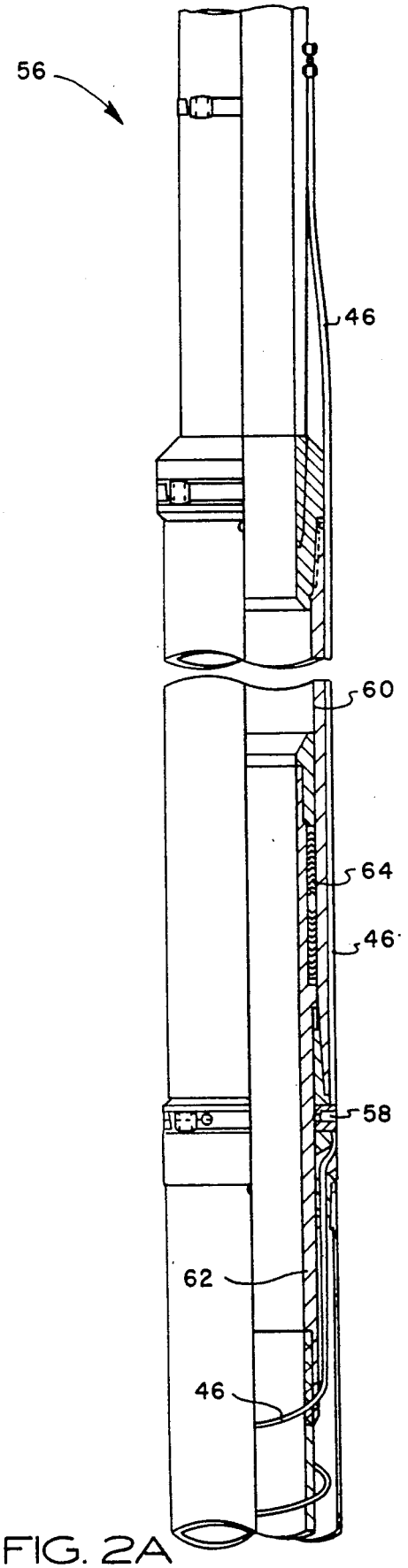
FIG. 2A is a elevational view, partly in section, of the top half section of the travel joint shown in FIG. 1A.
Figure 2B:
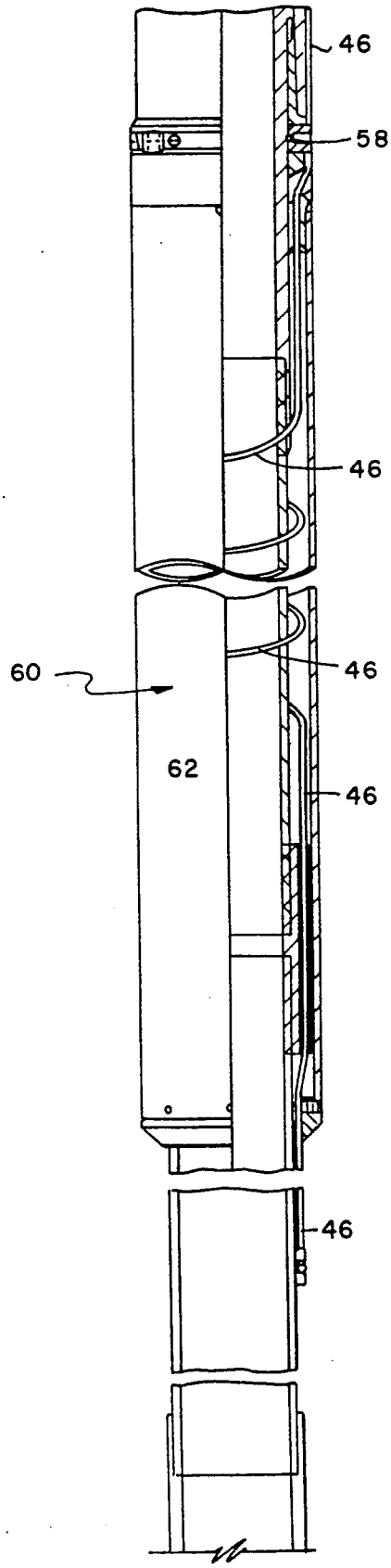
FIG. 2B is a continuation of FIG. 2A which illustrates the lower half section of the travel joint shown in FIG. 2A.
Figure 3A:
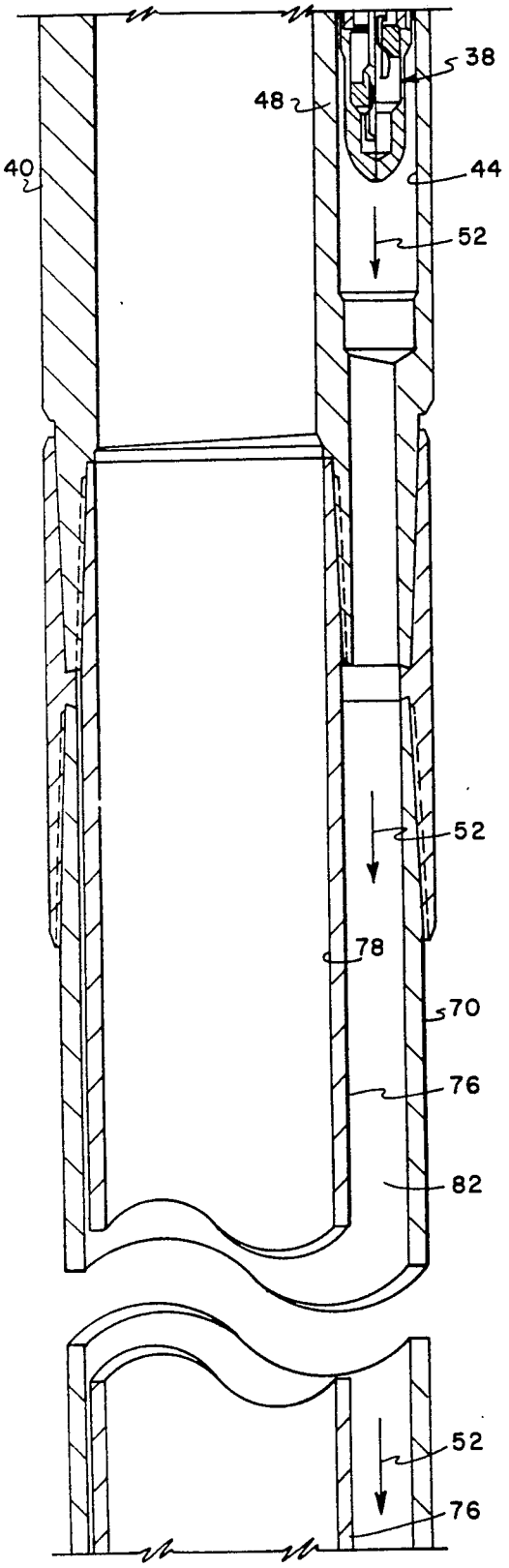
FIG. 3A, FIG. 3B, FIG. 3C and FIG. 3D are longitudinal sectional views, partially broken away, of a dual flow seal assembly.
Figure 3B:
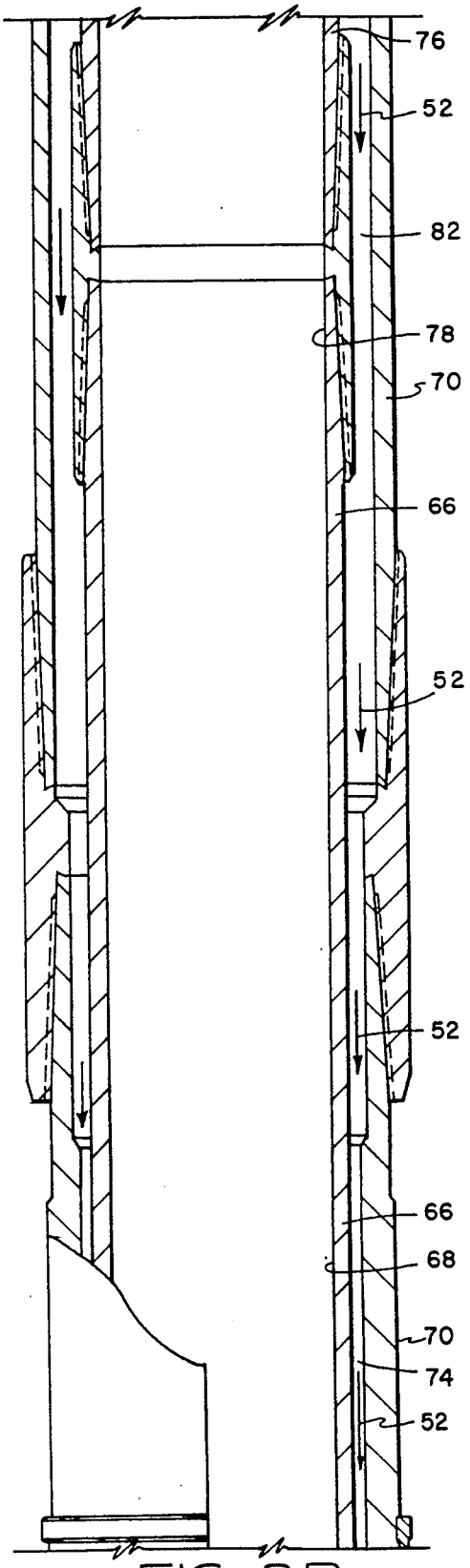
Figure 3C:
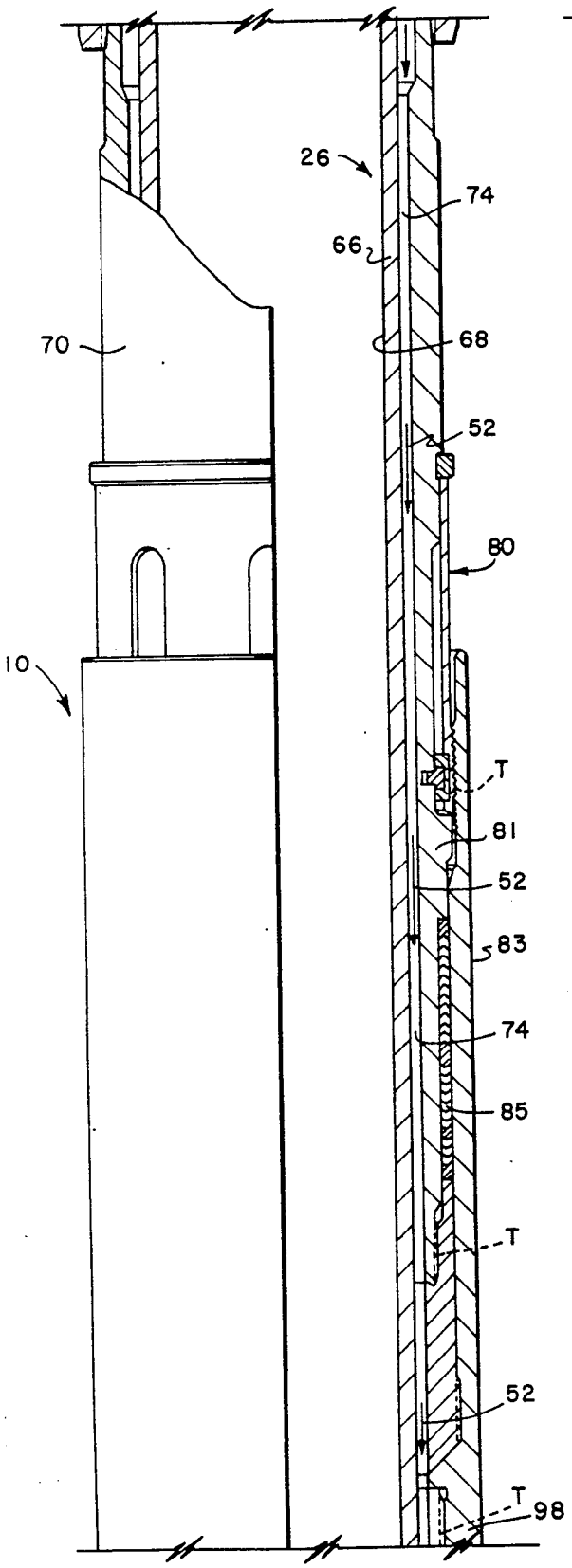
Figure 3D:
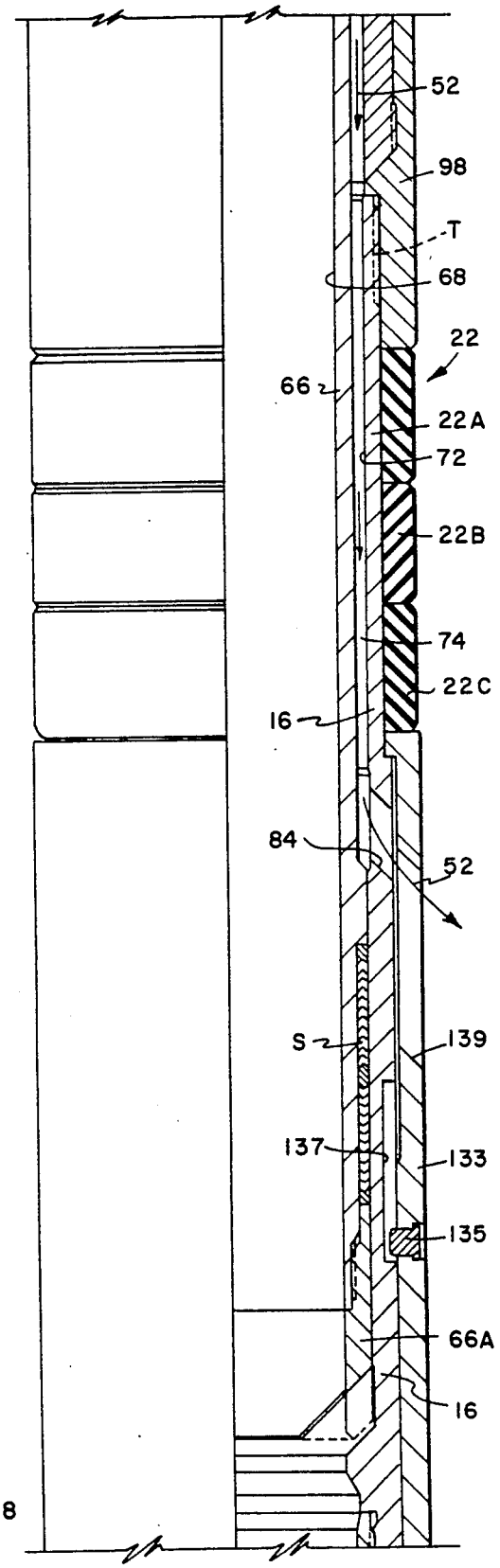

For the purpose of compensating for tubing contraction and elongation of the production tubing string, a travel joint 56 is connected in series with the production tubing between the dual flow seal assembly 26 and the production safety valve 32. Referring to FIG. 1A, FIG. 2A and FIG. 2B, the travel joint 56 is coupled into the production tubing 28 by threaded pin and box unions, thereby forming an integral part of the production string. During initial installation, the travel joint is retracted, and after the packer 10 has been set, the travel joint 56 is actuated by shearing pins 58. This permits separation of the outer tubing mandrel 60 from the inner tubing mandrel 62. The inner tubing mandrel 62 is received in telescoping engagement within the bore of the outer tubing mandrel 60. The interface between the inner and outer tubing mandrels is sealed by an annular packing seal 64. According to this arrangement, the tension forces induced within the production tubing 28 above the packer 10 as a result of the hang weight of the production tubing 28T below the packer is relieved after the packer 10 has been set against the well casing bore 12.

Referring now to FIGS. 1A, 3A, 3B, 3C and 3D, an intermediate component of the gas lift completion assembly is the dual flow production seal unit 26 which is connected in series with the production tubing string 28. The dual flow production seal unit 26 includes a twin flow mandrel 66 which has a large diameter production bore 68. The twin flow production seal unit 26 also includes a coupling sub 70 which is concentrically received within the production bore 72 of the packer 10. The twin flow mandrel 66 is radially spaced from the packer bore 72, thereby defining a bypass annulus 74.

The twin flow mandrel 66 is connected to the side pocket sub 40 by an offset transition sub 76. The offset transition sub 76 has a production bore 78 which has the same diameter as the side pocket sub production bore 42 and production tubing bore 28A. The outer coupling sub 70 is joined to the side pocket sub 40 by a threaded pin and box connection, at its upper end, and is joined on its lower end to the packer mandrel 16 by a annular coupling sub 80. The coupling sub 80 includes a latch mandrel 81 which is joined to the packer mandrel by a threaded coupling collar 83. The latch mandrel 81 is sealed against the coupling collar 83 by a packing seal 85.

The offset transition sub 76 is radially spaced inside of the coupling sub 70, thereby defining an annular flow passage 82 into which pressurized lift gas is discharged through the lift gas safety valve 38. According to an important feature of the invention, the bypass flow annulus 74 is connected in fluid communication with the lower well casing annulus 20B by multiple discharge ports 84 which intersect the packer mandrel sidewall 16. According to this arrangement, lift gas conducted through the bypass flow annulus 74 is discharged into the annulus 86 between the packer mandrel 16 and the well casing 14. The annulus 86 is formed by the spacing established by the radial projection of the anchor slips 18. The lift gas 52 flows downwardly through the circumferential gaps 88 between adjacent sets of anchor slips 18. The twin flow mandrel 66 is sealed at its lower end against the packer mandrel 16 by seal elements S.

Lift gas 52 injected into the upper casing annulus 20A through the surface valve 54 is thereafter conducted through the inlet port 50 of the lift gas safety valve 38 into the annular flow passage 82 within the coupling sub 70, and then through the bypass flow annulus 74. The lift gas thereafter is discharged through the packer mandrel outlet ports 84 into the lower casing annulus 20B. Elastomeric seals S carried on the landing collar 66A of the twin flow mandrel 66 form a fluid barrier against the packer bore 72 to prevent undesired fluid communication between the upper casing annulus 20A and the lower packer mandrel bore 24.

Referring now to FIGS. 1A and 1B, the tailpipe production tubing string 28T includes a normally closed relief valve 90 mounted or releasably secured in a side pocket sub 40 as described above. The side pocket mandrel 40 includes a production bore 42 connected in communication with the bore of tailpipe production tubing string 28T, and an inlet port 50 which is normally closed by the relief valve 90. The side pocket mandrel in which the relief valve 90 is mounted is disposed above the fluid level FL as can be seen in FIG. 1B. When it is desired to relieve the pressure within the lower casing annulus 20B, a wire line tool is inserted through the bore of the production tubing string 28 and is jarred down against an actuator head portion of the valve, with the result that the body of the relief valve 90 is displaced downwardly through the side pocket housing, thereby opening inlet port 50 so that high pressure gas 52 accumulated within lower casing annulus 20B is vented into the side pocket mandrel bore 42 and into the production bore 28A.

During the production mode of operation, the relief valve 90 is closed, and lift gas 52 is conducted through the lift gas safety valve 38 through inlet port 50 into the lower casing annulus 20B until a desired operating pressure level is achieved. Production of formation fluid 92 is enhanced by injecting the lift gas 52 into the column of formation fluid below the fluid level FL through one or more gas lift valves G which are mounted onto the tailpipe production tubing string 28T below the hanger packer 10. It should be noted that in a typical gas lift installation, the relief valve 90 will be positioned above the fluid level FL at a relatively shallow depth, whereas the gas lift valves G will be located below the fluid level FL at much greater depths, for example 7,000–10,000 feet. Optional equipment such as a well packer WP is anchored within the lower casing annulus 20B below the gas lift valves G.

The gas lift valves G are received within a side pocket sub 40 of the type previously described. The side pocket sub 40 includes an offset mandrel housing 48 having an inlet port 50 through which lift gas 52 is admitted from the lower casing annulus 20B. An example of a gas lift valve G which is satisfactory for use in this invention is described in the aforementioned U.S. Pat. No. 4,294,313 to Harry E. Schwegman. Gas lift valve G is a check valve which can be inserted and removed from the side pocket mandrel as shown in the Schwegman patent. Gas lift valve G admits the flow of high pressure lift gas 52 from the lower casing annulus 20B into the bore of the tailpipe production string 28T, but blocks the reverse flow of fluids through port 50.

Formation fluid 92 enters the bore of the tailpipe production tubing string 28T and is conducted upwardly through the bore 58 of the twin flow mandrel 66. The twin flow mandrel bore 68 opens into direct fluid communication with the tailpipe production string 28T which is hung off of the packer 10. The upper end of the twin flow mandrel bore 68 is joined in fluid communication with the bore 28 of the offset transition tubing 76 at the dual flow seal assembly 26. The bypass flow passage 62 between the packer bore 72 and the twin flow mandrel 66 is connected through the packer mandrel ports 84 in direct fluid communication with the lower casing annulus 20B. The lower casing annulus 20B is pressurized to an appropriate pressure level by high pressure lift gas conducted through the lift gas safety valve 38, transition flow passage 82 and bypass annulus 74 for providing lift gas assistance for producing formation fluid 92 through the production tubing 28.

The lower casing annulus 20B remains pressurized for as long as lift gas 52 remains available and hydraulic control pressure is applied to the control inlet port of the lift gas safety valve 38. In the event the supply of hydraulic control fluid is lost, for example, as a result of damage to well head equipment at the surface, both the production safety valve 32 and the lift gas safety valve 38 are adapted to automatically close to prevent the loss of production fluids, and also to prevent the loss of the large volume of compressed lift gas 52 in the lower casing annulus 20B. Upon removal of hydraulic pressure from the control lines 46, 56, spring loaded closure elements in the production safety valve 32 and in the lift gas safety valve 38 release spring loaded valve closure elements in the production safety valve 32 and in the lift gas safety valve 38, respectively.

The side pocket sub 40 has an elongated pocket 94 in which the safety valve 38 has been loaded, preferably by a kick-over tool as described in U.S. Pat. No. 4,294,313 to Harry E. Schwegman. The hydraulic flow control line 46 is connected in fluid communication with a control inlet port through a hydraulic fitting. The hydraulic control line 46 and the hydraulic fitting deliver high pressure hydraulic control fluid into the pocket annulus between the lift gas safety valve 38 and the pocket bore. The pocket annulus is sealed above and below the control inlet port by annular packing seal members 94, 96.

Figure 4A:
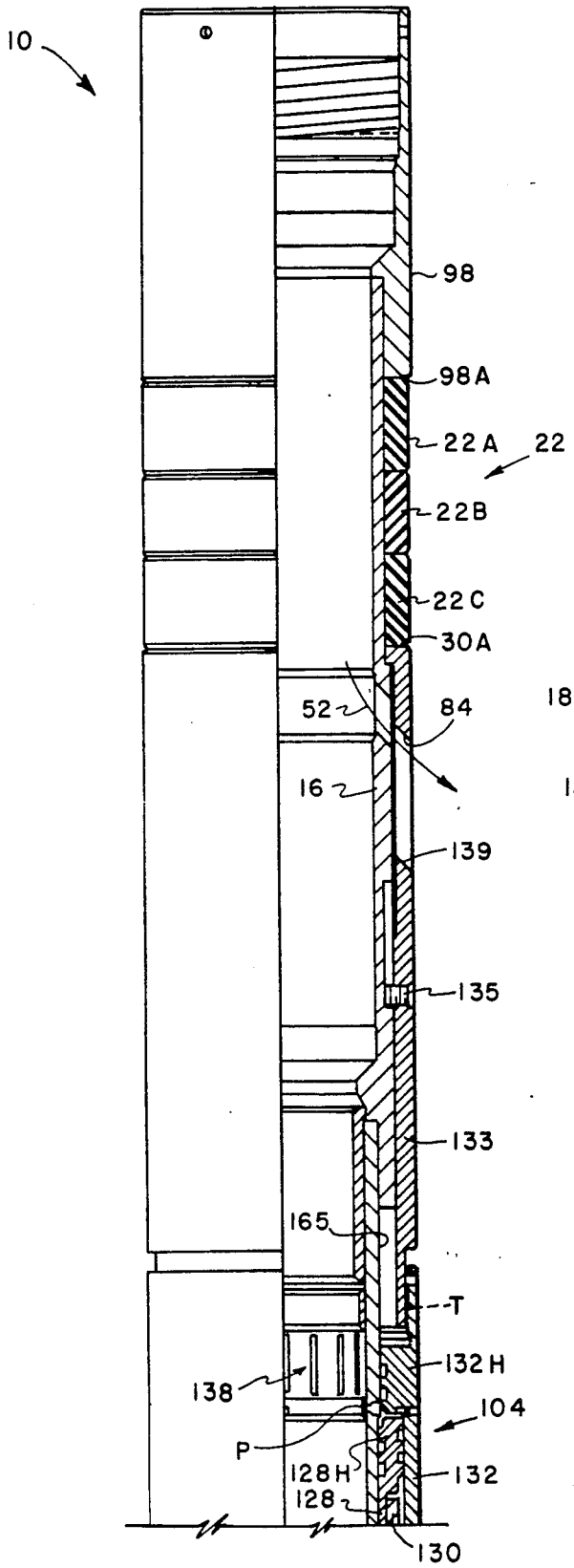
FIG. 4A is an elevational view, partly in section, of the top half section of the hanger packer shown in FIG. 1A.
Figure 4B:
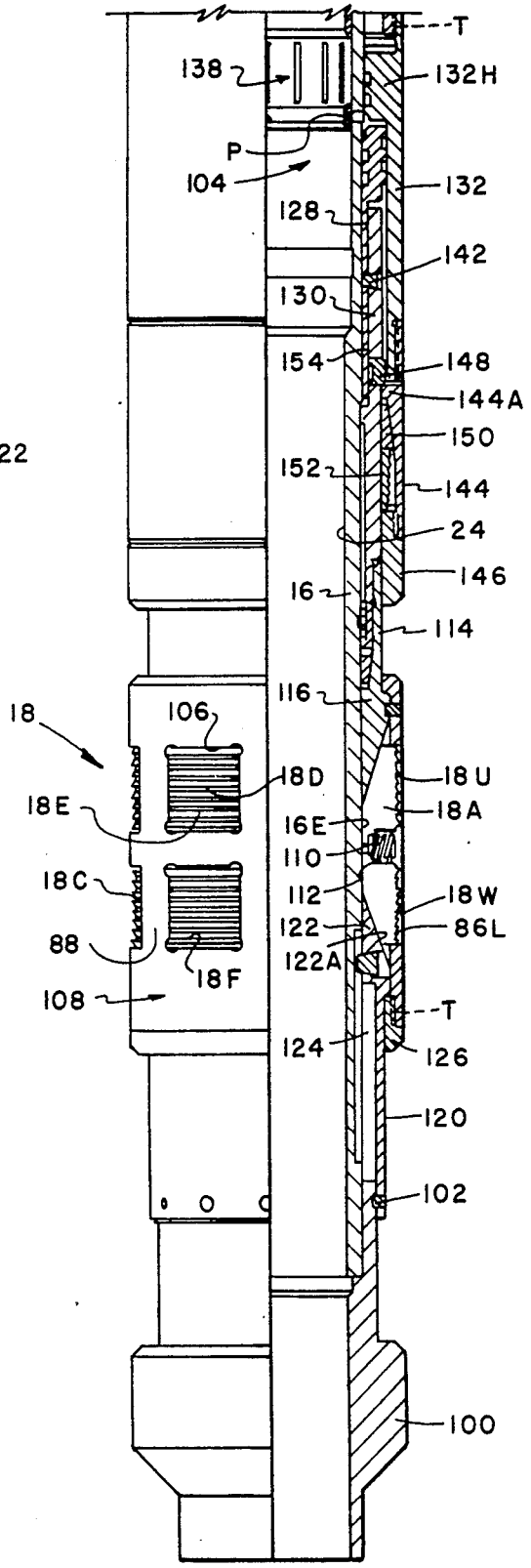
FIG. 4B is a continuation of FIG. 4A, showing an elevational view, partly in section, of the lower half section of the hanger packer shown in FIG. 4A; and, FIG. 5 is an enlarged elevational view, partly in section, which illustrates the setting components of the hanger packer.

Referring now to FIGS. 1A, 4A and 4B, connected to the upper section of the packer mandrel 16 is an internally threaded coupling collar 98 for engaging the coupling sub 70 in a threaded union. The lower end of the packer mandrel 16 is connected to a tubular bottom sub 100 by a shearable release coupling assembly 102, which is interconnected to permit release and retrieval of the packer 10 from a well bore, as discussed in further detail hereinafter. The tailpipe tubing string 28T is attached by threaded engagement onto the bottom sub 100 and is continued below the packer within the well casing by means of additional tailpipe tubing elements extended downwardly through the casing bore for supporting the lift gas injection valves G. The central passage of the packer mandrel 24 as well as the bottom sub bore 100A are concentric with and form a continuation of the tubular bore of the production tubing string.

The annular seal element assembly 22 and the slip anchoring assembly 18 are both radially extendable as described hereinafter to engage the bore of the surrounding well casing 14. Additionally, the packer includes a hydraulic actuator assembly 104 concentrically mounted about and onto the packer mandrel 66 between the annular seal element assembly 22 and the slip anchor assembly 18.

The seal element assembly 22 is mounted directly onto the external surface of the packer mandrel 16 and resides between the lower annular face 98A of the top coupling collar 98 and the upper annular face 30A of the hydraulic actuator assembly. The seal element 22 includes an upper packing element 22A, a center packing element 22B and a lower packing element 22C. The upper packing element 22A is fixed against axial upward movement relative to the packer mandrel 16 by engagement against the lower annular face 98A of the top collar 98. The shape, number and method of mounting the seal elements included in the seal assembly 22 may be varied as known in the art while still providing a seal assembly that may be expanded radially to securely engage the well casing bore surrounding the packer 10.

The slip anchor assembly 18 includes a plurality of slip anchors 18A, 18B, 18C and 18D which are mounted for radial movement through windows 106 formed in a tubular slip carrier 108. While the number of anchor slips 18 may be varied, the tubular slip carrier 108 is provided with an appropriate corresponding number of windows 106, with four anchor slips 18 being preferred. Each of the anchor slips 18 includes upper and lower gripping surfaces 18U, 18L, respectively, positioned to extend radially through the windows 106 with the wall of the slip carrier 108 between the paired windows confining a coil spring 110 which resides in a recess 112 of the anchor slip. The coil spring 110 biases the anchor slips 18 radially inwardly relative to the wall of the slip carrier 108, thereby maintaining the gripping surfaces 18U, 18L retracted in the absence of setting forces displacing the anchor slips radially outwardly. Each of the gripping surfaces 18U, 18L has horizontally oriented gripping edges 18E, 18F, respectively, which provide gripping contact in each direction of longitudinal movement of the packer 10. The gripping surfaces, including the horizontal gripping edges, are radially curved to conform with the cylindrical internal surface of the well casing bore against which the slip anchor members may engage.

The hydraulic actuator assembly 104 is coupled to each slip anchor assembly 18 by a tubular top wedge assembly 114 which extends between the external surface 16E of the mandrel, and the internal bore 108A of the slip carrier. The top wedge assembly 114 features a spreader cone 116 which extends downwardly within the slip carrier bore 108A and fits under an inwardly directing flange 108B of the slip carrier. The spreader cone 116 and slip carrier flange 108B have mating shoulders which define the limit of axial movement of the spreader cone 116 upwardly relative to the slip carrier 108. The spreader cone 116 has a downwardly facing, frustoconical wedging surface 116A which is generally complementary to the upwardly facing, slanted upper cam surface 118 of the anchor slip 18A.

A bottom wedge assembly 120 is positioned between the external packer mandrel surface 16E and the lower bore of the slip carrier 108 and includes an upwardly facing frustoconical spreader cone 122 having a wedging surface 122A generally complementary to the downwardly sloping anchor slip cam surface 119. The lower wedge assembly 120 is received within an annular pocket 124 defined between an annular stop ring 126 and the external packer surface 16E. Longitudinal travel of the tubular bottom wedge 120 is limited by the shear screws 102, which react compression forces transmitted through the anchor slip assembly 18 upon being engaged by the upper spreader cone 114. In the run-in position as illustrated in FIGS. 4A and 4B, the tubular bottom wedge 120 is fully retracted within the annular pocket 124, and consequently, as the top wedge assembly 114 is driven into engagement with the anchor slip assembly 18, the anchor slips 18A, 18B, 18C and 18D are displaced radially outwardly as the spreader cones 116, 122 engage and slip along the sloping cam surfaces 118, 119, respectively. The lower cone 122 is blocked against further downward movement relative to the slip carrier by the shear screws 102.

Figure 5:
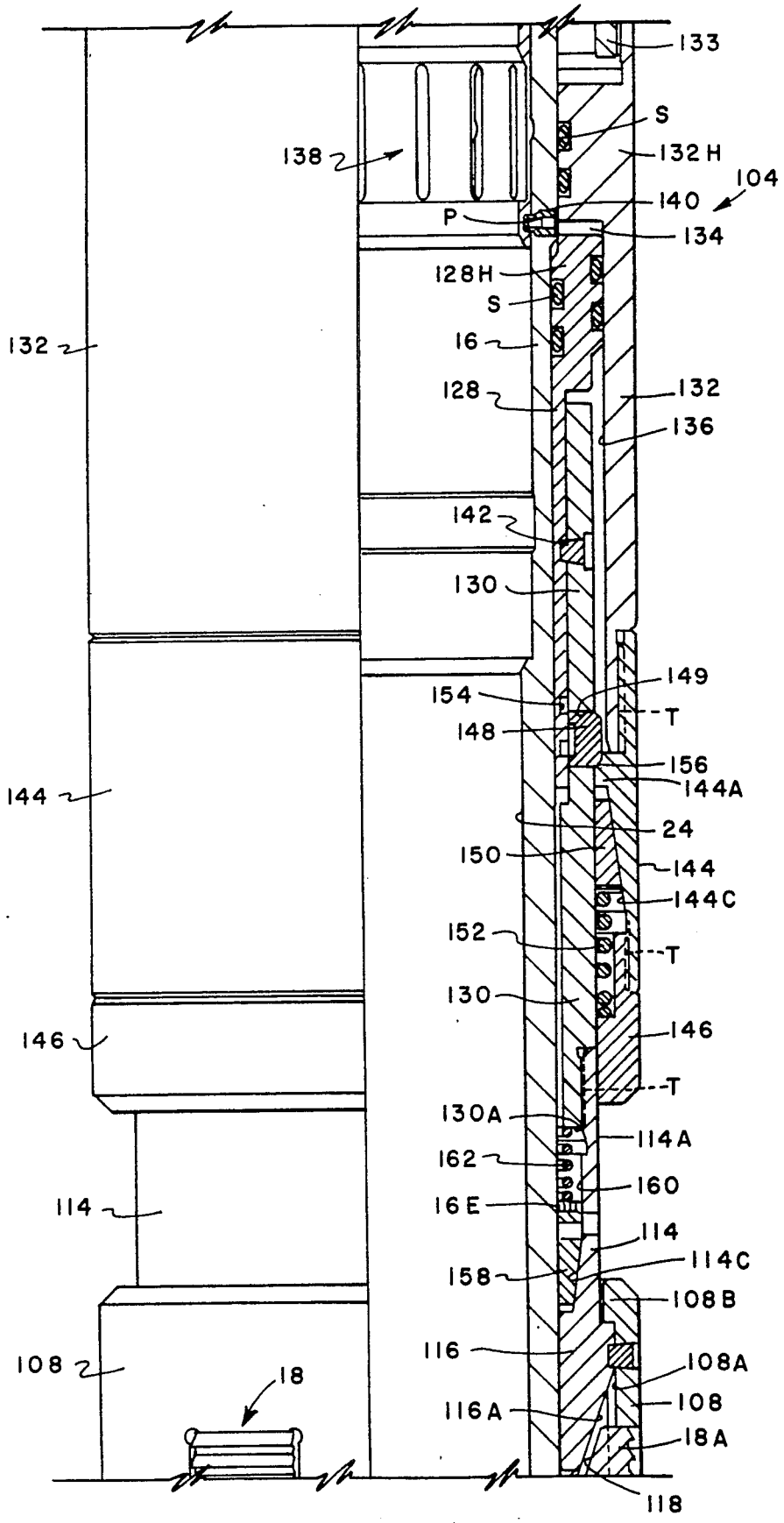

Referring now in particular to FIG. 4A and FIG. 5, the hydraulic actuator assembly 104 includes an annular force transmitting setting piston 128 connected to a tubular link portion 130. The inner piston bore 128A is sealed against the external cylindrical surface 16E of the packer mandrel by an internal O-ring seal S. The piston 128 is mounted for slideable movement along the packer mandrel surface 16E, and is also disposed in slideable, sealing engagement against the internal cylindrical bore of a force transmitting setting cylinder 132. The setting cylinder 132 has an annular head portion 132H which rides in sealing engagement against the external mandrel surface 16E, with the interface being sealed by an internal O-ring seal S. The setting cylinder 132 is joined by a threaded union T to a tubular extension 133 on which the annular face 30A is formed. Movement of the setting cylinder 132 and extension 133 is guided by an anti-rotation lug 135. The lug 135 travels in a longitudinal slot 137 formed in the packer mandrel 16. The tubular extension 133 has an elongated port 139 which is aligned in flow registration with the mandrel port 84.

The annulus 134 between the setting cylinder bore 136 and the external mandrel surface 16E defines a variable volume pressure chamber for directing hydraulic pressure against the piston head 128H and setting cylinder head 132H. Hydraulic fluid pumped down the tubing string and into the packer bore enters the pressure chamber 134 through one or more radial setting ports P (FIG. 4B).

The packer 10 is made up onto the production tubing string 28 prior to run-in. The dual flow seal unit is likewise stabbed into the packer bore at the time it is made up onto the tubing string and is then lowered into the well bore. Once the packer reaches the depth at which it is to be set, a wire line tool, for example a BO shifting tool, is run through the tubing string for engaging a shoulder of a shiftable set sleeve 138. After the shifting tool has engaged the shifting sleeve, a jarring tool is inserted through the bore for shearing a hollow pin 140. After the hollow pin 140 has been sheared, the setting port P is opened, hydraulic fluid is pumped down the tubing string 128 into the packer bore and pressurizes the pressure chamber 134.

After the packer 10 has been completely set, the apparatus used to plug the production tubing string to permit the piston chamber to be pressurized is removed. For example, a ball (not illustrated) may be dropped through the bore of the tubing string and into the dual flow seal unit to direct flow through the setting port P. For example, such a ball setting device may be flowed up the tubing string if the packer 10 has been set in a producing well. Otherwise, means may be provided for disposing of such a ball, or other plugging means, either up or down the well.

The piston 128 and piston linkage member 130 are mechanically coupled to the top wedge assembly 40 by one or more shear pins 142. Preferably, a total of six shear pins 142, spaced in a symmetrical pattern, are utilized to provide a predetermined level of connector strength between the setting piston and the top wedge 114. The top wedge assembly 114 includes a tubular extension 114A which is joined to the piston linkage 130 by a threaded union T. The setting cylinder 132 includes a tubular extension 144 which is connected to a tubular slip receiver 146 by a threaded union T. In this arrangement, the slip receiver 146 rides in overlapping, surface-to-surface engagement against the external surface of the piston link portion 130.

The setting cylinder 132 is initially restrained from extension by the blocking engagement of a transfer lug 148 carried within a radial bore 149 formed in the tubular sidewall of the piston linkage member 130. The head of the transfer lug 148 is received within the bore 136 of the setting cylinder 132. According to this arrangement, the setting cylinder 132 is blocked from extension against the annular packing seal element assembly 22 by engagement of the setting cylinder extension shoulder 144A against the transfer lug 148. The setting piston 128, together with the piston linkage 130, are likewise blocked against extension by the connection of the shear screw 142 onto the piston linkage 130, which is blocked by engagement of the transfer lug 148 against the slip housing shoulder 144. Thus, the setting piston and setting cylinder are mechanically locked against extension movement which would tend to prematurely set the packing seal elements and the anchor slips by the blocking and locking action of the shear screw 142 and the transfer lug 148.

The setting cylinder extension 144 defines a slip housing having a sloping conical surface 144C defining a pocket in which an annular locking slip 150 is received. The locking slip 150 is positioned internally of the slip housing 144 and is coupled thereto by coarse, upwardly facing buttress threads which engage and bite into the bore of the slip housing, thereby preventing downward retraction of the slip housing relative to the piston linkage 130 while permitting upward extension of the slip housing and setting cylinder 132 against the annular seal element assembly 22. The construction and function of the external locking slip 150 in relation to the sloping surface 144C of the slip receiver is similar to the construction and function of the top wedge and anchor slip engagement. The slip receiver carries upwardly facing buttress threads which permit the slip housing 144 and setting cylinder 132 to ratchet upwardly, but downward movement is prevented by the wedging action and biting engagement as the external locking slip 150 is urged along the sloping surface 144C of the slip receiver. The external locking slip 150 is biased for wedging movement along the sloping surface 144C by a compression spring 152. The compression spring 152 is retained by the slip receiver 146.

The locking action of the external slip 150 against downward movement prevents downward movement of the setting cylinder 132 since such movement would cause the buttress threads to wedge the external slip ring even tighter into engagement against the slip housing 144. Consequently, once the setting cylinder 132 has been driven upwardly and fully extended into compressive engagement against the annular seal element assembly 22, the slip housing 144 and setting cylinder 132 are securely locked against retraction after the hydraulic driving pressure has been removed.

In the set position, the packer seal element assembly 22 is radially extended, and the anchor slips 18A, 18B, 18C and 18D are radially extended for engagement against the well casing bore 12. At the onset of extension, the shear strength of the shear screws 142 is overcome, with the result that each shear screw severs into two pieces, thereby permitting the piston 128 to move downwardly relative to the piston linkage portion 130. As the piston 128 moves downwardly, the transfer lug 148 is pushed into an annular slot 154 machined into the external surface of the tubular piston sidewall 128. The transfer lug 148 is driven into the annular pocket 154 by a sloping bore surface 156 formed on the upper end of the slip housing shoulder 144A.

At the same time, the extended position of the slip housing 144 is maintained by the external ratchet slip 150. The piston link portion 130 becomes mechanically coupled to the piston 128 as the transfer lug 148 is driven into the annular slot 154. After the transfer lug 148 is loaded into the annular slot 154, the piston and top wedge assembly 114 become permanently linked together for concurrent movement. Upon extension of the anchor slips 18, the tubular wedge assembly 114, slip receiver 144 and piston link portion 130 become rigidly secured in place. The forces of compression transmitted through the top wedge assembly 114 and slip anchor assembly 18 are reacted through the bottom wedge assembly 120 and the shearable release coupling 102.

Release and radial retraction of the packer seal assembly 22 and the anchor slip assembly 18 are accomplished to permit retrieval of the packer 10 from the well bore. In this embodiment, the packer is released from the set configuration by a straight upward pull of the tubing string 28 and the packer mandrel 16 relative to the outer packer seal assembly 22 and anchor slip assembly 18.

As the upper and lower spreader cones 116, 122 are retracted, the anchor slips 18 are driven radially inwardly by the compression springs 110. As the mandrel 16 retracts relative to the outer hydraulic actuator assembly 104, the setting cylinder head 132H separates from the packer seal element assembly 22, thereby permitting the packer seal elements to retract radially out of engagement with the casing bore.

According to an important aspect of the invention, the hang weight load of the production tubing 28T below the packer 10 is unloaded with respect to the packer seal elements 22 by a set of internal ratchet slips 158 (FIG. 5) which transfer the hang weight load from the packer mandrel 16 onto the anchor slips 18 and the well casing 14. After tension in the tubing string 28 above the packer 10 has been relieved by actuation of the travel joint 56, the weight of the upper tubing string is also transferred from the seal element package 22 through the internal slips 158 and anchor slips 18 onto the well casing 14. In this arrangement, the internal ratchet slip 158 is received within a slip pocket 160 defined by the annulus between the top wedge assembly 114 and the external packer mandrel surface 16E. The internal ratchet slip 158 is positioned internally within the slip pocket 160 and is coupled to the top wedge assembly bore by coarse, downwardly facing buttress threads which engage and bite into the bore of the top wedge assembly 114, thereby preventing upward retraction of the top wedge assembly relative to the packer mandrel 16 while permitting downward extension of the spreader cone 116 against the anchor slips 18. The hang weight load of the tailpipe tubing string is therefore reacted through the packer mandrel 16, the internal ratchet slip 158, the spreader cone 116, the anchor slips 18 and the well casing 14.

By this arrangement, the hang weight loading is transferred to the well casing 14 at a point below the seal element package 22. Consequently, the well casing is subjected to loading by the seal element package 22 only at normal setting pressures, with the hang weight load of the tailpipe production tubing 28T and the stack weight of the upper production tubing above the packer being effectively removed from the seal element package, thereby avoiding yield deformation of the well casing. The internal locking slip 158 is biased for wedging movement along the sloping surface 114C by a compression spring 162. The compression spring 162 is retained by the lower annular face 130A of the tubular linkage member 130.

It will thus be apparent that in this preferred embodiment, the annular packing seal elements 22, the hydraulic actuator assembly 104 and the anchor slip assembly 18 are mounted directly onto the packer mandrel 16. Equal setting forces are applied to the annular seal elements and the anchor slips by the annular setting cylinder and setting piston which are mounted for slideable sealing engagement against the packer mandrel at a location intermediate the sealing elements and the anchor slips. The shear screw 142 which locks the setting piston and top wedge together in cooperation with the transfer lug 148 are unloaded with respect to mechanical impact forces transmitted through the packer mandrel.

The shear screw 142 and transfer lug 148 are enclosed within and shielded by the setting cylinder 132, thereby preventing inadvertent contact with well bore obstructions. Likewise, the piston and its seals are located below the main packer sealing elements 22, thereby minimizing the effect of leaky piston seals. By locating the piston below the main packer seals, the total number and size of the sealing surfaces required for an effective fluid seal are reduced.

In the preferred embodiment, the setting cylinder and tubular wedge are locked against relative movement by the shear screw to prevent presetting the packer prior to application of hydraulic pressure. Because the head of the setting cylinder has the same surface area as the head of the piston, equal but opposite setting forces are applied against the annular packing elements and the anchor slips, respectively. Moreover, upon loading of the transfer lug into the annular piston slot, the piston and slip setting wedge become mechanically linked together for concurrent movement and cannot thereafter be displaced axially with respect to each other. The advantage of this arrangement is that the piston and anchor slips are locked together with the slip housing so that the seals S mounted onto the piston head cannot be dragged against the mandrel and setting cylinder bore and worn out prematurely in response to hydraulic pressure fluctuations.

The use of the dual flow bypass seal unit permits a larger tubing size to be used without causing gas flow restriction. The exit ports for the lift gas flow are relocated from the conventional position below the packer to directly below the seal elements. The bypass seal unit assembly has sufficient length to allow an offset bore on the bottom of the side pocket mandrel to bend the production tubing into alignment for assembly into a concentric packer bore. The internal slips on the upper wedge of the packer inhibit the seal elements from causing casing damage. The external anchor slips are circumferentially spaced to permit the lift gas flow to flow through the annulus between the packer and the casing bore. In the preferred embodiment, the bypass seal unit permits $5\frac{1}{2}$ inch tubing to be used in a $9\frac{5}{8}$ inch well casing with an annular lift gas flow passage and an annular lift gas safety valve. The travel joint accommodates tubing elongation in the relatively short interval between the well head and the packer. The production tubing size limitation imposed by conventional stinger conduit completion arrangements is overcome by sealing the thin walled, dual flow bypass mandrel directly against the bore of the packer mandrel, with the lift gas being conducted through the bypass annulus and discharged through mandrel ports below the packer seal elements, and above the packer anchor slips.

While a preferred embodiment of the invention has been set forth for purposes of disclosure, modification to the disclosed embodiment of the invention as well as other embodiments thereof may occur to those skilled in the art. Accordingly, the appended claims are intended to cover all embodiments of the invention and modifications to the disclosed embodiment which do not depart from the spirit and scope of the invention.

What is claimed is:

1. Well completion apparatus for gas lift production comprising, in combination:

a side pocket mandrel having a longitudinal main bore defining a production flow passage therethrough and having a side pocket wall defining a longitudinally extending side pocket laterally offset with respect to said main bore, said side pocket wall having an open upper end, an open lower end, and said side pocket wall being radially intersected by a lift gas inlet port at a location intermediate said upper end and said lower end;

a lift gas safety valve disposed within said pocket, said lift gas safety valve including a valve body having an inlet port disposed in flow communication with said lift gas inlet port of said side pocket wall and having a gas outlet port disposed in flow communication with the lower open end of said side pocket wall;

a well packer having a tubular body mandrel connected to said side pocket mandrel, said tubular body mandrel having a bore defining a longitudinal flow passage in communication with the valve body outlet port, a seal element assembly mounted on said body mandrel, an anchor slip assembly mounted on said body mandrel, and an actuator assembly mounted on said body mandrel between said seal element assembly and said anchor slip assembly, said actuator assembly including first and second movable force transmitting members engagable with said seal assembly and said anchor slip assembly, respectively;

a bypass flow mandrel coupled to said side pocket mandrel in communication with said production flow passage, said bypass flow mandrel being disposed within the flow passage of said packer mandrel and being radially spaced with respect to said packer mandrel bore, thereby defining an annular bypass flow passage in communication with said valve body outlet port; and, said packer having a lift gas discharge port formed radially through said body mandrel in communication with said bypass passage at a location between said seal element assembly and said anchor slip assembly, and including a seal disposed between said bypass mandrel and said packer bore for sealing said annular bypass passage at a location intermediate the lift gas discharge port of said packer and said anchor slips.

2. Well completion apparatus for gas lift production comprising, in combination:

a side pocket mandrel having a longitudinal main bore defining a production flow passage therethrough and having a side pocket wall defining a longitudinally extending side pocket laterally offset with respect to said main bore, said side pocket wall having an open upper end, a lift gas discharge port formed on its lower end, and said side pocket wall being radially intersected by a lift gas inlet port at a location intermediate said open end and said discharge port;

a lift gas safety valve disposed within said pocket, said lift gas safety valve including a valve body having an inlet port disposed in flow communication with said lift gas inlet port of said side pocket wall and an outlet port disposed in flow communication with the discharge port of said side pocket wall;

a well packer including a mandrel, anchor slips and annular sealing elements for anchoring said mandrel in a well casing and sealing therebetween, said mandrel having a longitudinal bore communicating with the discharge port of the side pocket mandrel, and said mandrel having a lift gas discharge port formed radially through said mandrel at a location intermediate said sealing elements and said anchor slips;

a bypass seal unit including an annular coupling collar disposed in slidable engagement against the packer mandrel bore and a tubular bypass mandrel disposed within said packer mandrel bore, said bypass mandrel having a production bore defining a flow passage for formation fluid produced from said well, the annulus between the bypass mandrel and the packer bore defining an annular bypass flow passage for conducting lift gas from the upper casing annulus through the lift gas safety valve into the casing annulus below the packer; and, an annular seal mounted on said coupling collar for sealing the bypass annulus with respect to the bypass mandrel production bore, said coupling collar annular seal being disposed in sealing engagement against the packer mandrel bore at a position below the gas discharge port of the packer mandrel and above the anchor slips.

3. Well completion apparatus as defined in claim 2, including:

an upper production tubing string connected to said side pocket mandrel and coupled in fluid communication with the production bore of said side pocket mandrel; and, a surface controlled, subsurface production safety valve connected in said upper production tubing string, said production safety valve having a production flow passage communicating with said production tubing and a movable closure element for opening and closing said production flow passage.

4. Well completion apparatus as defined in claim 3, including:

a lower production tubing string connected to said well packer and coupled in fluid communication with the bypass mandrel bore; and, a normally open lift gas valve assembly mounted on said lower production tubing string below the fluid level of the well, said lift gas valve having an inlet port for admitting lift gas from said lower casing annulus, said lift gas valve being connected in fluid communication with the bore of the lower production tubing for conducting lift gas from the lower casing annulus into the lower production tubing string.

5. Well completion apparatus for use in combination with a well packer having anchor slips and seal elements for releasably engaging a well casing, said packer having a longitudinal bore for communicating with the casing annulus above and below said packer and having a radial bore gas discharge port for communicating with the casing annulus at a location intermediate said seal elements and anchor slips, said completion apparatus comprising, in combination:

a bypass seal unit including a tubular bypass mandrel having a production flow passage, said bypass mandrel being radially spaced from said packer mandrel bore, thereby defining an annular bypass flow passage, and having a coupling collar for insertion into the packer bore, said coupling collar carrying an annular seal for sealing the bypass flow passage with respect to the production flow passage said coupling collar annular seal being disposed in sealing engagement against the packer mandrel bore at a position below the gas discharge port and above the anchor slips;

a production tubing member coupled to said bypass mandrel in communication with said production flow passage;

a surface controllable, subsurface safety valve coupled in flow communication with said production tubing member, said safety valve having a production flow passage and a movable closure element for opening and closing said flow passage; and, a gas lift safety valve mounted on said production tubing member, said gas lift safety valve having a lift gas flow passage and a movable closure element for opening and closing the lift gas flow passage, said lift gas safety valve having an inlet port disposed in communication with the upper casing annulus for admitting lift gas, and having a discharge port coupled in communication with said bypass flow passage in said bypass seal unit for conducting lift gas from the upper casing annulus into the bore of said packer.

6. A method for producing a gas lift well of the type having a casing and a well packer having anchor slips and seal elements releasably set against said casing comprising the steps:

running a string of production tubing including a bypass seal unit into said well with said bypass seal unit having a bypass mandrel extending through a flow passage bore in said packer, the bore of said bypass mandrel defining a production flow passage for conducting formation fluid through said packer, and the annulus between said packer bore and said bypass mandrel defining an annular bypass flow passage for conducting lift gas from the well casing annulus above the packer into the packer bore;

pressurizing the well casing annulus above the packer with lift gas;

discharging pressurized lift gas from the well casing annulus above the packer into the bypass annulus between the bypass mandrel and the packer bore;

conducting lift gas through said bypass annulus and discharging it into the lower casing annulus through a radial discharge port in the packer mandrel at a location between said anchor slips and said seal elements;

sealing the annular bypass flow passage with respect to the bypass mandrel bore at a location intermediate the radial discharge port of the packer mandrel and the anchor slips;

discharging lift gas from the lower casing annulus into the production tubing through a gas lift valve attached to the production tubing at a location below said packer; and, producing formation fluid from said well through said production tubing and through the production bore of said bypass mandrel.

* * * * *